US009472836B2

(12) United States Patent
Deleniv et al.

(10) Patent No.: US 9,472,836 B2
(45) Date of Patent: Oct. 18, 2016

(54) WAVEGUIDE E-PLANE FILTER STRUCTURE

(75) Inventors: Anatoli Deleniv, Molndal (SE); Piotr Kozakowski, Goteborg (SE); Ove Persson, Hunnebostrand (SE)

(73) Assignee: Telefonaktiebolaget LM Ericsson (publ), Stockholm (SE)

( * ) Notice: Subject to any disclaimer, the term of this patent is extended or adjusted under 35 U.S.C. 154(b) by 406 days.

(21) Appl. No.: 13/643,910

(22) PCT Filed: Apr. 27, 2010

(86) PCT No.: PCT/EP2010/055609
§ 371 (c)(1),
(2), (4) Date: Oct. 26, 2012

(87) PCT Pub. No.: WO2011/134497
PCT Pub. Date: Nov. 3, 2011

(65) Prior Publication Data
US 2013/0038407 A1 Feb. 14, 2013

(51) Int. Cl.
*H01P 1/213* (2006.01)
*H01P 1/207* (2006.01)
*H01P 1/201* (2006.01)

(52) U.S. Cl.
CPC ..... *H01P 1/2138* (2013.01); *H01P 1/207* (2013.01); *H01P 1/2016* (2013.01)

(58) Field of Classification Search
CPC ..... H01P 1/207; H01P 1/209; H01P 1/211; H01P 1/208; H01P 1/2138
USPC ..... 333/135, 208
See application file for complete search history.

(56) References Cited

U.S. PATENT DOCUMENTS

| | | | | |
|---|---|---|---|---|
| 3,914,713 | A | 10/1975 | Konishi et al. | |
| 4,881,051 | A * | 11/1989 | Tang | H01P 1/2084 333/135 |
| 5,051,714 | A * | 9/1991 | Bentivenga et al. | 333/227 |
| 6,127,908 | A * | 10/2000 | Bozler et al. | 333/246 |
| 6,392,508 | B1 | 5/2002 | Damphousse et al. | |
| 7,355,496 | B2 * | 4/2008 | Lo Hine Tong | H01P 1/2016 333/208 |
| 7,456,711 | B1 | 11/2008 | Goldsmith | |
| 2003/0184407 | A1 * | 10/2003 | Tsunoda | H01P 1/202 333/110 |

FOREIGN PATENT DOCUMENTS

| | | | | |
|---|---|---|---|---|
| EP | 0274859 | * | 7/1988 | H01P 1/213 |
| WO | 03065496 | A1 | 8/2003 | |

OTHER PUBLICATIONS

Young et al. "Integrated E-Plane Fitters with Finite Frequency Transmission Zeros" Microwave Conference, 1994, 24th European, IEEE, Sep. 5, 1994, XP031604994, pp. 460-465.

* cited by examiner

*Primary Examiner* — Robert Pascal
*Assistant Examiner* — Gerald Stevens
(74) *Attorney, Agent, or Firm* — Rothwell, Figg, Ernst & Manbeck, P.C.

(57) ABSTRACT

A waveguide E-plane filter component comprising a first main part and a second main part which in turn comprise a corresponding first and second waveguide section part. The main parts are arranged to be mounted to each other, each waveguide section part comprising a bottom wall, corresponding side walls and an open side, where the open sides are arranged to face each other. The waveguide E-plane filter component further comprises at least one electrically conducting foil that is arranged to be placed between the main parts, said foil comprising a filter part that is arranged to run between the waveguide section parts, the filter part comprising apertures, in said foil.

9 Claims, 4 Drawing Sheets

WAVEGUIDE E-PLANE FILTER STRUCTURE

CROSS REFERENCE TO RELATED APPLICATION(S)

This application is a 35 U.S.C. §371 National Phase Entry Application from PCT/EP2010/055609, filed Apr. 27, 2010, designating the United States, the disclosure of which is incorporated herein in its entirety by reference.

TECHNICAL FIELD

The present invention relates to a waveguide E-plane filter component comprising a first main part and a second main part, each part in turn comprising a corresponding first and second waveguide section part. The main parts are arranged to be mounted to each other, each waveguide section part comprising a bottom wall, corresponding side walls and an open side. The open side of the first waveguide section part is arranged to face the open side of the second waveguide section part. The waveguide E-plane filter component further comprises at least one electrically conducting foil that is arranged to be placed between the first main part and the second main part when the main parts are mounted to each other, said foil comprising a filter part that is arranged to run between the waveguide section parts, the filter part comprising apertures in the foil.

BACKGROUND

When designing microwave circuits, transmission lines and waveguides are commonly used. A transmission line is normally formed on a dielectric carrier material. Due to losses in the dielectric carrier material, it is sometimes not possible to use any transmission lines. When there for example is a filter component in the layout, it may have to be realized in waveguide technology. Waveguides are normally filled with air or other low-loss materials.

Despite quite impressive progress demonstrated in the last few decades in the microwave engineering area, the important role of waveguide components remains undisputed, this is due to their low loss and high power capability performance.

A waveguide E-plane filter component normally comprises two main parts, a first main part comprising a first waveguide section part and a second main part comprising a second waveguide section part. Each waveguide section part comprises three walls; a bottom and corresponding sides.

The first main part and the second main part are arranged to be mounted together such that the first waveguide section part and the second waveguide section part face each other, and together constitute a resulting waveguide section part. This means that each main part comprises a half-height waveguide section part where, when mounted together, the resulting waveguide section part constitutes a full-height waveguide section part.

The electromagnetic field propagates parallel to the intersection. Since the waveguide section part normally have equal sizes, and thus the same height of the corresponding sides, the dominant $TE_{10}$ mode of the electromagnetic field has its maximum magnitude at said intersection.

Between the main parts, at the intersection, an electrically conducting foil is placed, having a filter part comprising full height or partial-height apertures. The filter part runs between the waveguide section parts.

In order to improve the spectral selectivity and stop-band attenuation, a class of filters for which an amplitude transfer function has attenuation poles at finite frequencies is used. The transmission zeros, attenuation poles, at finite frequencies can be introduced by cross-coupling resonant cavities. Since this solution is not always realizable, the transmission zeroes at the finite frequencies can by introduced using band-stop resonators. Each band-stop resonator allows one to realize one transmission zero either below or above the pass-band of the filter. An E-plane band-stop resonator is usually realized in the form of a T-junction with one port being short-circuited. Such a T-junction is comprised in the main parts with the conductive foil disposed in between the main parts, realizing the coupling between the band-stop cavity and the rest of the E-plane filter.

These T-junctions constitute so-called extracted cavities, allowing realization of said transmission zeroes. These extracted cavities are constituted by relatively small confined openings.

Generally, the benefit of an E-plane filter is that the same main parts can be used for the filters working at different center frequencies and/or covering different bandwidths at different frequency bands. This may be achieved by using the same main parts and change the electrically conducting foil to one having the aperture configuration that provides the desired frequency characteristics.

However, when a waveguide filter design based on E-plane technology is concerned, the relative positions of extracted cavities in the form of said T-junction need to be fixed. The distance between a common port of the waveguide filter and an extracted cavity thus needs to be fixed for a given frequency characteristic of the waveguide filter. This limits the possibility of having the same main parts and replacing the conductive foil disposed between the main parts to realize different filter characteristic.

There is thus a desire to obtain a microwave waveguide E-plane filter structure, where the structure may be used for different center frequencies and/or frequency bands by only changing the electrically conducting foil according to the above.

SUMMARY

The object of the present invention is to present a microwave waveguide E-plane filter structure, where the structure may be used for different center frequencies and/or frequency bands by only changing an electrically conducting foil.

This object is obtained by means of a waveguide E-plane filter component comprising a first main part and a second main part, each part in turn comprising a corresponding first and second waveguide section part. The main parts are arranged to be mounted to each other, each waveguide section part comprising a bottom wall, corresponding side walls and an open side. The open side of the first waveguide section part is arranged to face the open side of the second waveguide section part. The waveguide E-plane filter component further comprises at least one electrically conducting foil that is arranged to be placed between the first main part and the second main part when the main parts are mounted to each other, said foil comprising a filter part that is arranged to run between the waveguide section parts, the filter part comprising apertures in the foil. The filter part at least partly comprises at least one foil loop constituted by a foil conductor having a starting point and an end point, said foil conductor at least partly running in a corresponding further aperture in said foil, dividing said corresponding aperture in a first part and a second part.

According to an example, the first part is U-shaped and the second part is positioned at least partly inside the U-shape, where the second part may have a round shape.

According to another example, the waveguide section parts have corresponding at least two branches, where each branch comprises a foil.

Other examples are evident from the dependent claims.

A number of advantages are obtained by means of the present invention, for example

- Only one type of main parts has to be made for a certain frequency band, leading to lower productions costs and easier logistic handling due to fewer different types of main parts.
- A less expensive versatile filter arrangement is obtained.
- Different types of foils are easily manufactured, stored and handled.

BRIEF DESCRIPTION OF THE DRAWINGS

The present invention will now be described more in detail with reference to the appended drawings, where.

DETAILED DESCRIPTION

Figure 1:
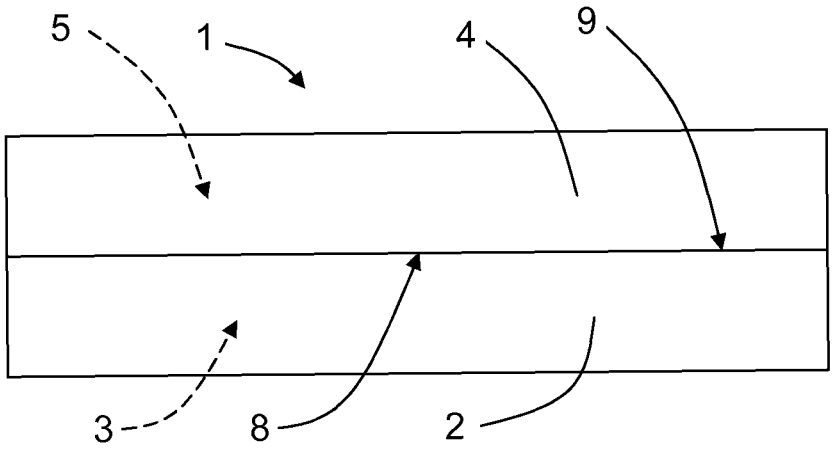
FIG. 1 shows a diplexer comprising a first main part and a second main part.
Figure 2:
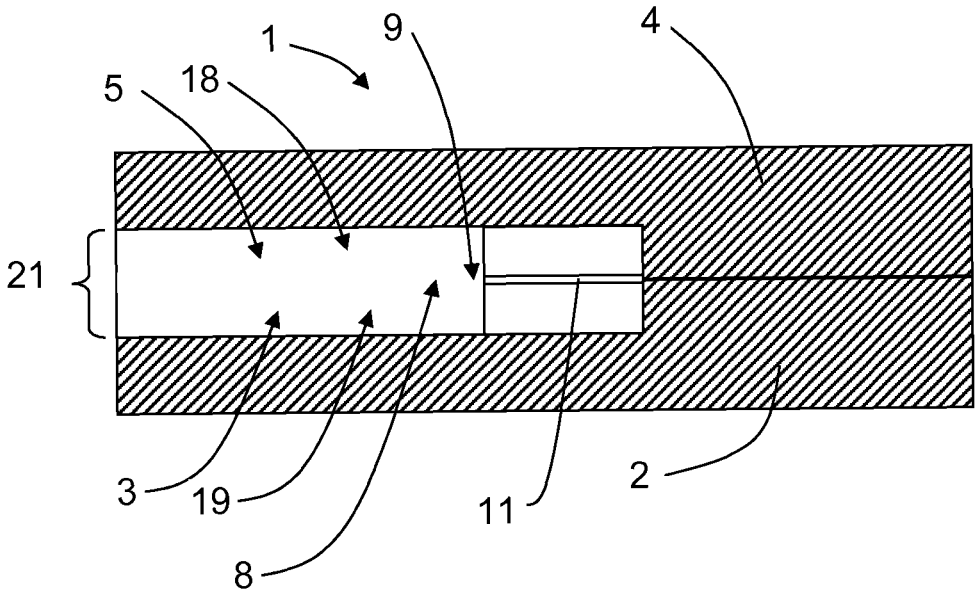
FIG. 2 shows a cross-section of FIG. 1.

With reference to FIG. 1 and FIG. 2, FIG. 2 showing a section of FIG. 1, a waveguide E-plane filter diplexer 1 comprises a first main part 2, which in turn comprises a first waveguide section part 3, and a second main part 4, which in turn comprises a second waveguide section part 5. The first waveguide section part 3 and the second waveguide section part 5 are only indicated schematically in FIG. 1, and the first waveguide section part 3 will be described more in detail in the following, the second waveguide section part 5 being similar.

As shown in FIG. 1 and FIG. 2, the main parts 2, 4 are arranged to be mounted to each other, the waveguide section parts 3, 5 thus facing each other.

Figure 3:
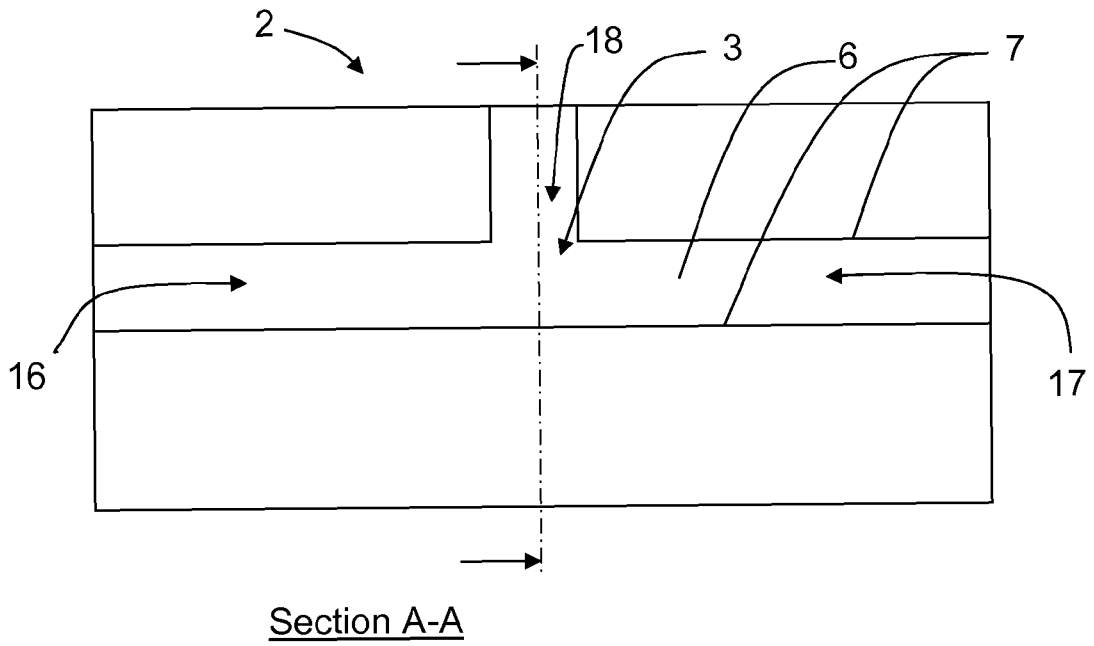
FIG. 3 shows a first main part.
Figure 4:
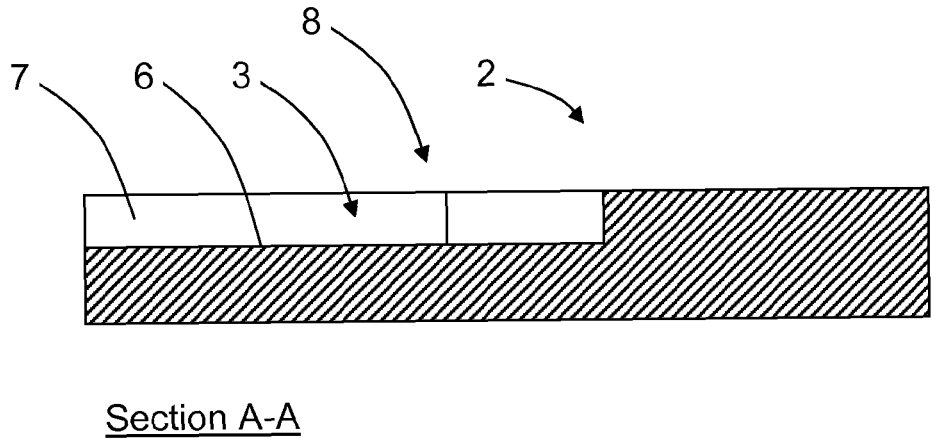
FIG. 4 shows a cross-section of FIG. 3.

With reference to FIG. 3 and FIG. 4, FIG. 4 showing a section of FIG. 3, the first main part 2 will now be described more in detail, and it is to be understood that the second main part 4 has a corresponding appearance. The waveguide section part 3 comprises a bottom wall 6, corresponding side walls 7 and an open side 8, where the open side 8 of the first waveguide section part 3 is arranged to face an open side 9 of the second waveguide section part 5, schematically indicated in FIG. 1 and FIG. 2.

The waveguide section part 3 further comprises a first branch 16 and a second branch 17, these branches 16, 17 being combined to a third branch 18. Corresponding branches constitute the second waveguide section part 5, a corresponding third branch 19 is shown in FIG. 2. When the first main part 2 and the second main part 4 are mounted, these branches face each other such that corresponding combined branches are formed, as being schematically indicated by the reference number 21 in FIG. 2.

Figure 5:
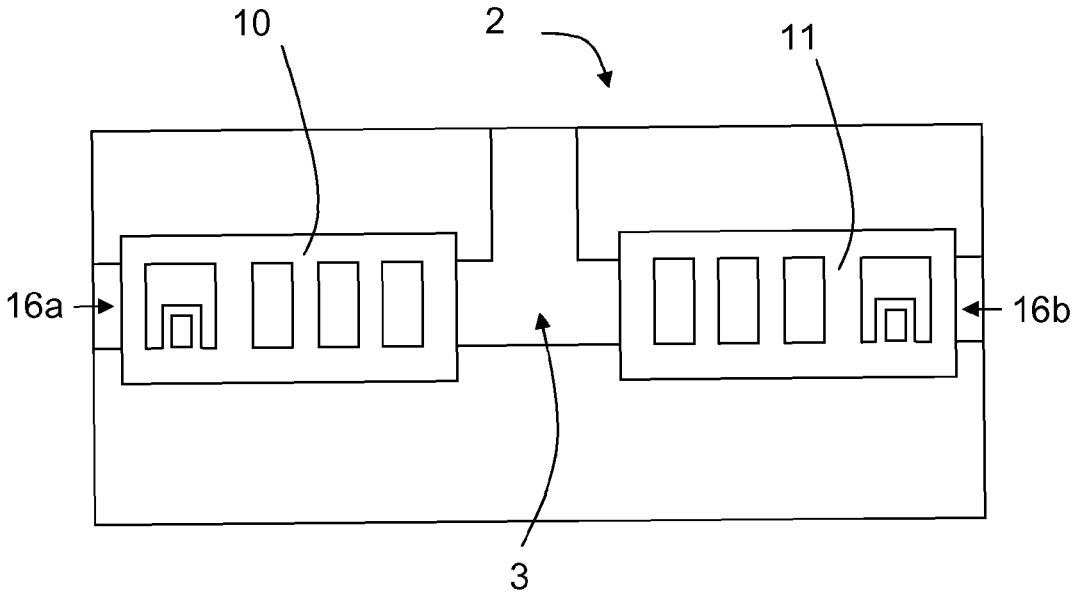
FIG. 5 shows a the first main part with electrically conducting foils.

With reference to FIG. 5, for reasons of clarity only showing the first main part 2, the diplexer 1 further comprises a first electrically conducting foil 10 for the first branch 16 and a second electrically conducting foil 11 for the second branch 17, the electrically conducting foils 10, 11 being arranged to be placed between the first main part 2 and the second main part 4 when the main parts 2, 4 are mounted to each other as shown in FIG. 2, showing the second electrically conducting foil 11 in its position.

Figure 6:
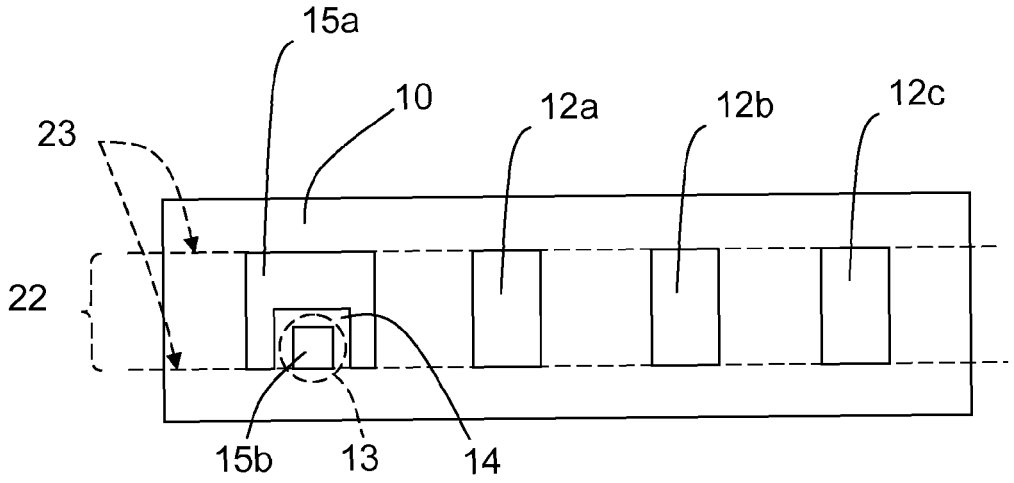
FIG. 6 shows a first type of electrically conducting foil.

With reference also to FIG. 6, showing the first electrically conducting foil 10, the first electrically conducting foil 10 comprises a filter part 22 that is arranged to run between the waveguide section parts 3, 5. The filter part 22 is indicated with dashed lines 23, the dashed lines 23 being intended to follow the side walls 7 when the first electrically conducting foil 10 is mounted to the first main part 2 such that the filter part 22 follows the side walls 7. The first electrically conducting foil 10 comprises apertures 12*a*, 12*b*, 12*c*, and as apparent from FIG. 5, the second electrically conducting foil 11 comprises corresponding apertures.

When the first main part 2 and the second main part 4 are mounted, as shown in FIG. 2, the filter part 22 will also follow the side walls of the second waveguide section 5 in a corresponding manner.

According to the present invention, with reference to FIGS. 5 and 6, for each electrically conducting foil 10, 11, the filter part 22 comprises a foil loop 13 constituted by a foil conductor 14 having a starting point and an end point. The foil loop 13 is schematically indicated with a dashed line. The foil conductor 14 at least partly runs in a corresponding further aperture 15*a*, 15*b* in said foil, dividing the corresponding aperture 15*a*, 15*b* in a first part 15*a* and a second part 15*b*.

By means of the foil loop 13, there is no need for "extracted cavities" in the diplexer, which means that the same main parts 2, 4 may be used for different frequency bands, and where only the electrically conducting foils 10, 11 will have to be changed for the desired frequency band, and where the electrically conducting foils 10, 11 thus are electrically matched for a certain frequency band.

Figure 7:
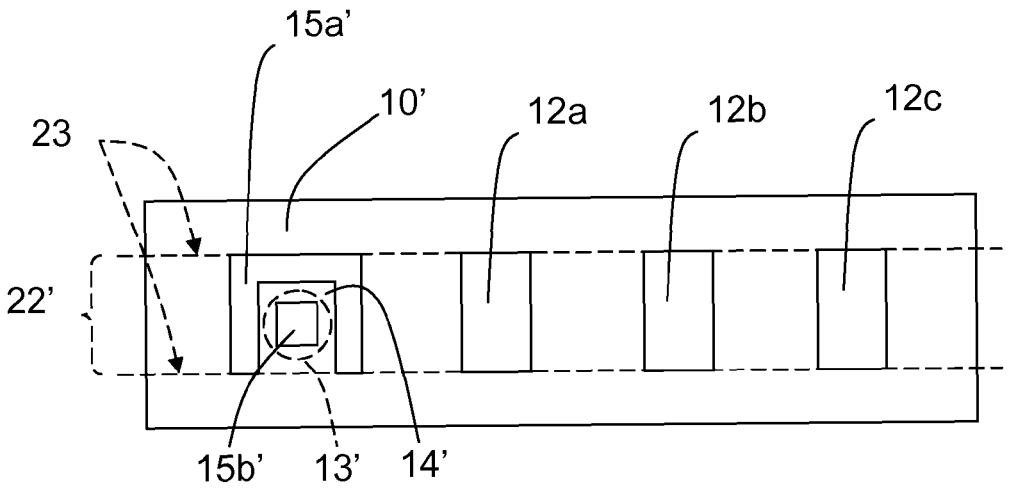
FIG. 7 shows a second type of electrically conducting foil.

The foil loop 13 shown in FIG. 6 has one part where the foil conductor 14 is positioned completely outside the filter part 22, but that is not necessary. With reference to FIG. 7, showing another type of electrically conducting foil 10', the foil loop 13' and thus the foil conductor 14' is positioned inside the filter part 22' to a larger extent, the second part 15*b*' of the further aperture 15*a*', 15*b*' being positioned such that total loop that is completely inside the filter part 22 is obtained.

Figure 8:
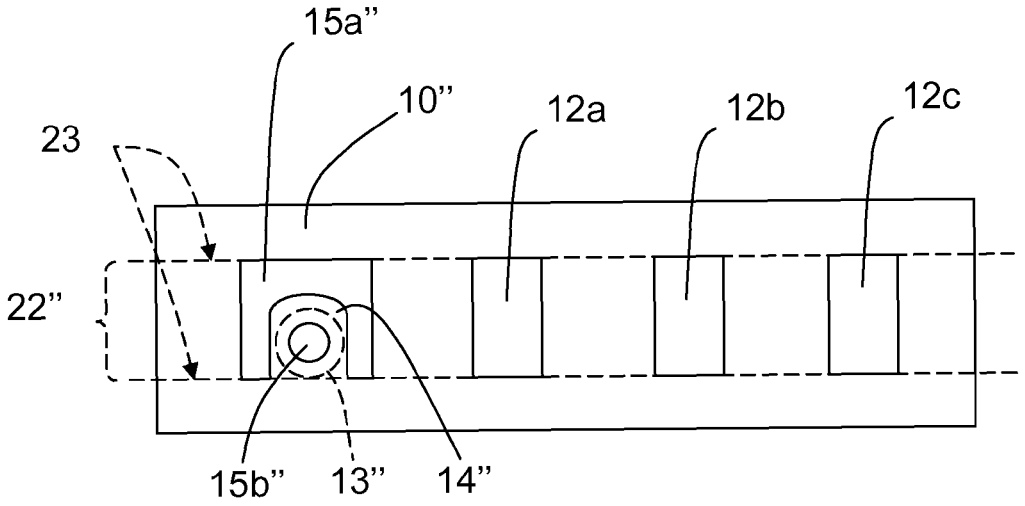
FIG. 8 shows a third type of electrically conducting foil.

The further aperture 15*a*, 15*b* may have many different forms, one example is illustrated in FIG. 8, where the second part 15*b*" of the further aperture 15*a*", 15*b*" is round and the first part 15*a*" of the further aperture 15*a*", 15*b*" has rounded corners. The shape of these detail have effects on the shape of the foil conductor 14" and the properties on the foil loop 13".

The present invention is not limited to the examples above, but may vary freely within the scope of the appended claims. For example, the diplexer shown is only on example of a waveguide E-plane filter component that is suitable for the present invention. Other types are easily conceivable for the skilled person, and may for example be single filters, having only one branch or triplexers.

Each electrically conducting foil 10, 11 may have any number and shape of apertures 12*a*, 12*b*, 12*c*, and more than one of the further apertures 15*a*, 15*b* comprising the foil loop according to the present invention.

The conducting foil 10, 11 may be made in any suitable material such as copper, gold or aluminium.

The main parts 2, 4 may be made in any suitable material such as aluminium or plastics covered with an electrically conducting layer.

Of course the present invention may not only be used for changing frequencies for an E-plane waveguide filter in an easy and cost-effective manner, but many other filter characteristics may also be changed by means of the present invention, such as the number of poles.

The invention claimed is:

1. A waveguide E-plane filter component comprising:

a first main part comprising a first waveguide section part and a second main part comprising a second waveguide section part, the first and second main parts being mounted to each other, each of the first and second waveguide section parts comprising an outer wall, corresponding side walls and an open side, where the open side of the first waveguide section part is arranged to face the open side of the second waveguide section part when the main parts are mounted to each other, wherein the waveguide E-plane filter component further comprises at least one electrically conducting foil comprising a plurality of spaced apart first apertures, said electrically conducting foil being between the first main part and the second main part so as to extend between at least a portion of the first and second waveguide section parts forming a filter part, said electrically conducting foil comprising a loop shaped foil conductor part extending into one of the plurality of first apertures, the looped shaped foil conductor part forming a second aperture within said one of the plurality of first apertures, wherein any of said first and second waveguide section arts is free from an extracted cavity.

2. The waveguide E-plane filter component according to claim 1, wherein said one of the plurality of first apertures forms a first part and said second aperture within said one of the plurality of first apertures forms a second part, and the first part is U-shaped and the second part is positioned at least partly inside the U-shape.

3. The waveguide E-plane filter component according to claim 1, wherein said one of the plurality of first apertures forms a first part and said second aperture within said one of the plurality of first apertures forms a second part, and the second part has a round shape.

4. The waveguide E-plane filter component according to claim 1, wherein each of the waveguide section parts forms at least two branches, wherein each branch comprises said at least one electrically conducting foil.

5. The waveguide E-plane filter component according to claim 1, wherein said at least one foil loop part is positioned completely inside the filter part of said at least one electrically conducting foil.

6. The waveguide E-plane filter component according to claim 1, wherein the at least one foil loop is approximately circular.

7. The waveguide E-plane filter component according to claim 6, wherein the position of the at least one foil loop part around the second aperture of the foil conductor part is such that the at least one foil loop circumscribes the second aperture.

8. The waveguide E-plane filter according to claim 1, wherein said portion of the first and second waveguide section parts between which said electrically conducting foil is arranged forms a waveguide section, wherein a cross-section of said waveguide section is substantially uniform.

9. The waveguide E-plane filter component according to claim 1, wherein the E-plane filter component comprises a second filter part and constitutes a waveguide diplexer.

* * * * *